US006140896A

United States Patent [19]

Heckenkamp

[11] Patent Number: 6,140,896

[45] Date of Patent: Oct. 31, 2000

[54] ELECTRO-MECHANICAL REVERSING CONTACTOR WITH A SINGLE, COMMON BASE

[75] Inventor: Daniel P. Heckenkamp, Oconomowoc, Wis.

[73] Assignee: Eaton Corporation, Cleveland, Ohio

[21] Appl. No.: 09/522,937

[22] Filed: Mar. 10, 2000

[51] Int. Cl.[7] ..... H01H 9/00

[52] U.S. Cl. ..... 335/159; 335/160; 335/162; 335/202; 200/50.32

[58] Field of Search ..... 335/132, 159–163, 335/202; 200/50.32–50.4

[56] References Cited

U.S. PATENT DOCUMENTS

| | | | |
|---|---|---|---|
| 3,453,569 | 7/1969 | Ostby | 335/132 |
| 3,824,510 | 7/1974 | Kolb et al. | 335/160 |
| 4,506,245 | 3/1985 | Lerude et al. | 335/160 |
| 4,525,694 | 6/1985 | Dennison et al. | 335/132 |
| 4,544,814 | 10/1985 | Butterworth et al. | 200/50 |
| 4,710,740 | 12/1987 | Dennison | 335/248 |
| 4,760,364 | 7/1988 | Ostby | 335/132 |
| 5,281,937 | 1/1994 | Young | 335/132 |
| 5,289,146 | 2/1994 | Plumeret et al. | 335/160 |
| 5,418,511 | 5/1995 | Theisen et al. | 335/201 |
| 6,002,579 | 12/1999 | Drexler et al. | 361/605 |

*Primary Examiner*—Lincoln Donovan
*Assistant Examiner*—Ray Barrera
*Attorney, Agent, or Firm*—Boyle Fredrickson Ziolkowski S.C.; Larry Vande Zande

[57] ABSTRACT

An electro-mechanical reversing contactor is disclosed in which a single common base is molded to receive two contactor powerheads. The common base has a bottom surface and upwardly extending sides, with an upwardly extending center divider, thereby forming two powerhead sockets. Each powerhead socket is capable of receiving a powerhead therein. The common base also has a circuit board pocket to receive a single circuit board to control both contactor powerheads. The center divider has an upwardly extending interlock tower to receive an interlock pawl that is engageable with each of the contactor powerheads. The interlock mechanism mechanically prevents both contactors from being energized at the same time. The common base for two powerheads saves labor and material costs in assembling and installing a reversing contactor.

18 Claims, 7 Drawing Sheets

ELECTRO-MECHANICAL REVERSING CONTACTOR WITH A SINGLE, COMMON BASE

BACKGROUND OF THE INVENTION

The present invention relates generally to electromagnetic contactors, and more particularly to an electro-mechanical reversing contactor having a common base and having a mechanical interlock.

Reversing contactors are known in the art and generally are comprised of two separate contactors, each having a powerhead that includes at least a pair of stationary contacts and a pair of movable contacts. The movable contacts are mounted on a movable carrier that is typically attached to an armature, all in the powerhead. Each powerhead is mounted in its own separate base housing that typically includes an electromagnet, that when energized, magnetically forces the armature to change positions and, typically, close the contacts. To form a reversing contactor, two such individual contactors are mounted side-by-side with some form of interlock therebetween.

Reversing contactors are typically used to connect motor windings of either a two-speed or a reversible motor directly to a power supply. Consequently, some means must be provided to preclude simultaneously closing the individual contactors. It is therefore a requirement that such contactors be positively interlocked to prevent the completion of a circuit through more than one relay at any given instant.

Various mechanical interlock devices have been devised to perform this function, and although such devices have generally served their purpose, no single device has proven entirely satisfactory from a cost, assembly, and operational standpoint. For example, some prior interlock devices are bulky in size utilizing a large number of parts which results in a complicated mechanism to perform the interlocking function. Such designs are generally costly to manufacture and are susceptible to failure. Further, some of these devices have outwardly exposed components, which may be easily defeated, invite tampering, or which may present a possible electrical hazard.

More recently, mechanical interlocking devices having fewer parts and being smaller in size have been developed which tend to minimize some of the aforementioned problems. However, these devices have not entirely satisfied the need for improvement in that many of these devices use small parts that make it difficult to assemble and/or repair. That is, these newer devices tend to require more care and assembly time to ensure that both contactors cannot be simultaneously energized at any given time. Some of the newer devices have interlocking elements which must be bent or must pivot in a comprehensive manner, and consequently, they tend to become less reliable with age and use since the interlocking element may fail to rebound to the neutral position and can remain in a blocking position at all times.

Mechanically linking or mounting two contactors is yet another labor intensive process and requires additional hardware. With the ever increasing cost of labor and the demand to reduce cost and materials, it would be advantageous to have a single, common base to receive two powerheads, thus eliminating two separate bases mounted to a common mounting plate. In such an arrangement, additional savings is achieved by the use of a single, common circuit board for both powerheads. It would be additionally advantageous to have such a common base that includes structure to provide an interlocking function between the two powerheads and uses minimal components and is relatively easy to assemble.

SUMMARY OF THE INVENTION

The present invention provides an electro-mechanical reversing contactor, which allows two electromagnetic powerheads to be mounted in a single, common base and carry a common printed circuit board that solves the aforementioned problems. The invention also includes a mechanical interlock that ensures that while one contactor is energized, the other is; mechanically prevented from engaging its contacts. The common base is also designed to allow both rail and panel mounting.

Accordingly, the present invention includes a reversing contactor having a single, common molded base with a plurality of upwardly extending sides and a center divider forming two powerhead sockets. The reversing contactor includes two powerheads, each powerhead having a housing, a set of stationary contacts mounted in the housing, a movable contact carrier having a set of movable contacts mounted thereon and in operable association with the stationary contacts, and an armature in movable relation with the movable contact carrier. The invention includes two coil and magnet assemblies each situated in a respective powerhead socket of the single, common molded base to apply a magnetic force to a respective armature and thereby move a respective movable contact carrier between a contact open position and a contact closed position.

In accordance with another aspect of the invention, a reversing contactor is disclosed having a pair of powerheads with both stationary and movable contacts for opening and closing a circuit. The reversing contactor includes a pair of coil assemblies for driving the movable contacts in the powerheads and a single circuit board for controlling the pair of coil assemblies. The reversing contactor includes a common molded base having a plurality of upwardly extending sides and a center divider for receiving the pair of powerheads and the pair of coil assemblies therein. The common molded base also has a circuit board pocket for receiving and retaining the single circuit board therein to control both powerheads.

In accordance with yet another aspect of the invention, a reversing contactor housing and interlock assembly is disclosed having a molded base with a bottom surface, a number of upwardly extending sides integrally molded to the bottom surface, and a center divider. The center divider has molded therein an upwardly extending interlock tower. The assembly also includes a pawl receivable in the upwardly extending interlock tower and having a pair of outwardly extending interlock pins, each engageable with a powerhead such that when one powerhead is energized, another powerhead is mechanically prevented from energizing.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
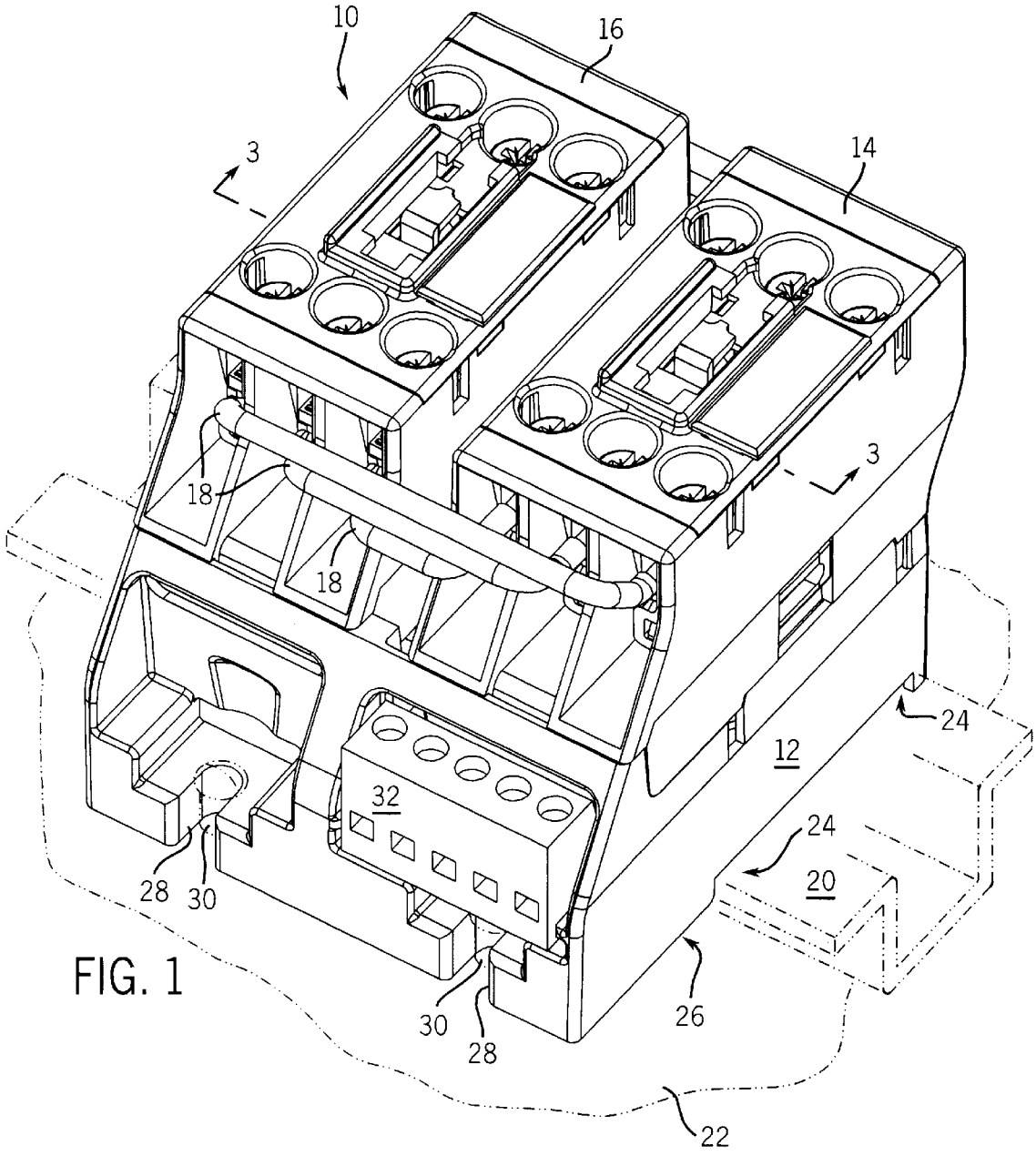
FIG. 1 is a perspective view of an electro-mechanical reversing contactor incorporating the present invention.

FIG. 1 shows an electro-mechanical reversing contactor 10 having a single, common molded base 12 and a pair of powerhead assemblies (hereinafter "powerheads") 14, 16 mounted thereon. The powerheads 14, 16 are interconnected electrically with jumper leads 18 and are, typically, connected to a reversible motor (not shown) to operate the motor in both forward and reverse directions. The reversing contactor 10 can either be mounted to a Din-rail 20 or a panel 22. The common molded base 12 has a mounting slot 24 on a lower end 26 to engage the rail 20. Housing 12 also has a plurality of mounting holes 28 to receive mounting bolts 30 therethrough for mounting to panel 22. The reversing contactor 10 also has a single wire harness connector 32 that is a removable 5-pole plug and designed to allow control of both powerheads 14, 16 via a common circuit board.

Figure 2:
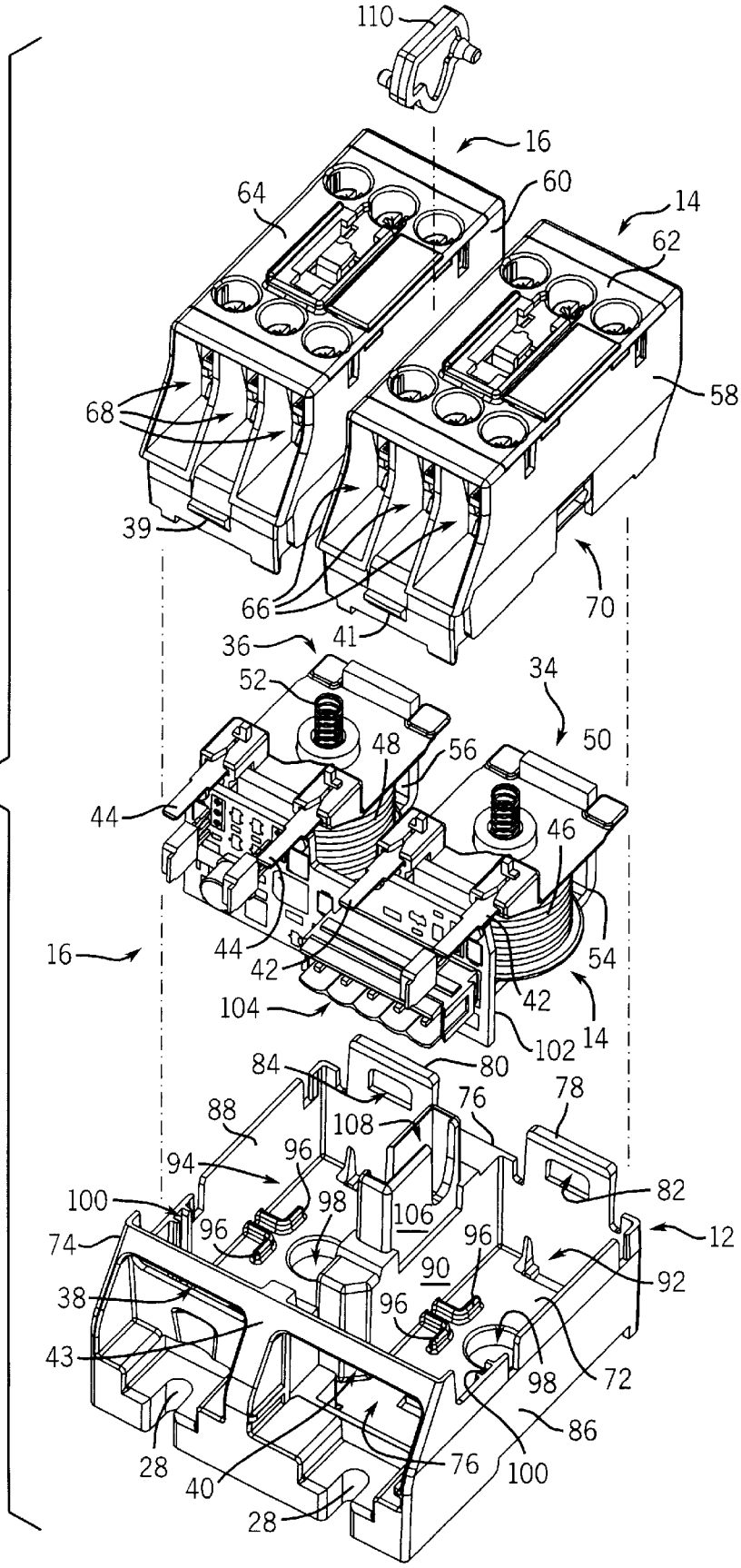
FIG. 2 is an exploded, perspective view of the main components of FIG. 1.

Referring to FIG. 2, the common base 12 is a one-piece molded base to receive therein powerheads 14, 16. The powerheads are attached to the common base 12 over a pair of magnetic coil assemblies 34, 36 that are seated in the common base 12. The magnetic coil assemblies 34, 36 have coil winding terminals 42, 44, wound bobbins 46, 48, return springs 50, 52, and magnets 54, 56, as is known. The powerheads 14, 16 include contactor housings 58, 60 with molded covers 62, 64 thereon. The powerheads 14, 16 each contain three sets of contacts 66, 68, operated by a movable contact carrier 70, 71, also as is known.

The molded base 12 has a number of upwardly extending sides with a common bottom section 72. In particular, a front side 74 has a circuit board conductor opening 76 and a pair of mounting holes 28 therein for mounting the reversing contactor 10 to a panel 22, as set forth with reference to FIG. 1. The front side 74 of base 12 also has a pair of apertures 38, 40, to receive clips 39, 41 of the powerheads 14, 16 therein. A rear side 76 is molded with the bottom section 72 and has tabs 78, 80, each with an aperture 82, 84 to secure therein the powerheads 14, 16. Lateral sides 86, 88 are integrally molded with the bottom section 72, the front side 74, and the rear side 76. A center divider 90 extends parallel with the lateral sides 86, 88 and perpendicular to the front and rear sides 74, 76, and is also integrally molded with the bottom section 72 and at least the rear side 76. This arrangement forms two powerhead sockets 92, 94, each capable of receiving therein a powerhead 14, 16. The base 12 has a number of L-shaped guides 96 on opposing sides of a circular opening 98 that are used for positioning and centering the coil assemblies 34, 36 in base 12. The molded base 12 also has a circuit board pocket 100 extending across the front side 74 of the molded base 12 to receive therein a single circuit board 102 that is engageable with each of the coil assemblies 34, 36. The circuit board 102 has a single wire harness connector socket 104 to provide control to both powerheads 14, 16.

The center divider 90 of the molded base 12 includes an upwardly extending interlock tower 106 integrally molded with the center divider 90 and the base 12. The interlock tower 106 has an aperture 108 at an upper end to receive an interlock pawl 110 therein. The operation and structure of the interlock-will be further described with reference to FIGS. 5–8.

Figure 3:
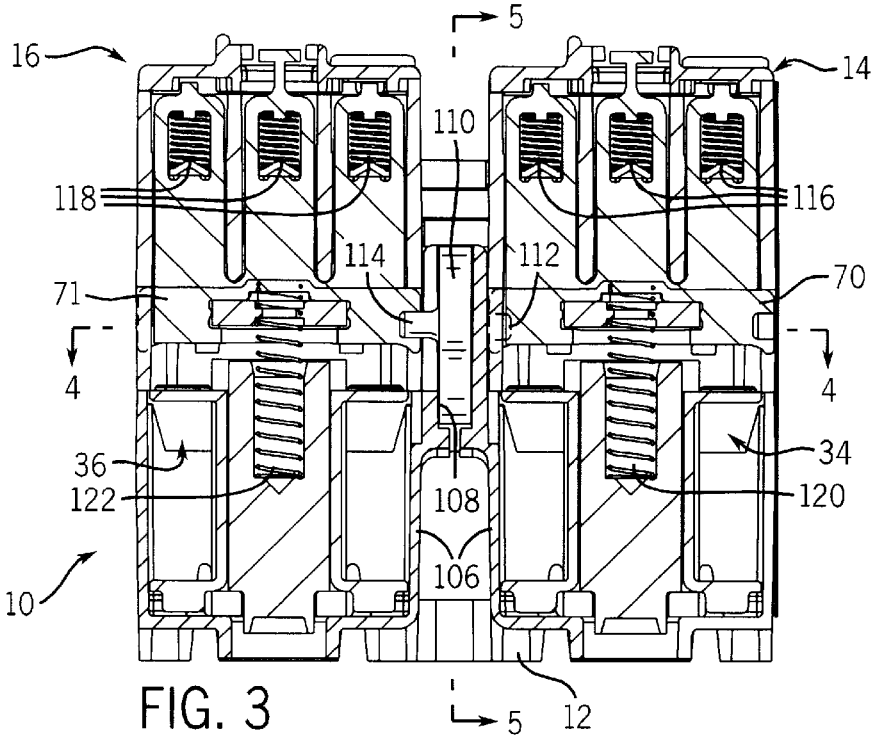
FIG. 3 is a sectional, elevation view taken along line 3—3 of FIG. 1.

FIG. 3 shows a cross-sectional view taken along line 3—3 of FIG. 1 and shows a cross-section of an assembled view of the powerheads 14, 16 in the molded base 12 with the magnetic coil assemblies 34, 36 therebetween. The cross-section is taken to show interlock pawl 110 within aperture 108 of the upwardly extending interlock tower 106. The interlock pawl 110 is shown engaged with the contact carrier 70 of the powerhead 14, through a first outwardly extending interlock pin 112 of the interlock pawl 110. Similarly, the interlock pawl 110 is engaged with contact carrier 71 of the powerhead 16, through a second interlock pin 114 of the interlock pawl 110. As indicated by the alignment of the interlock pins 112, 114 with a horizontal plane, the interlock pawl, and the contactors, are in a neutral position. FIG. 3 also shows contact pressure springs 116 and 118, in a neutral position, as well as coil return springs 120, 122, also in a neutral position.

Figure 4:
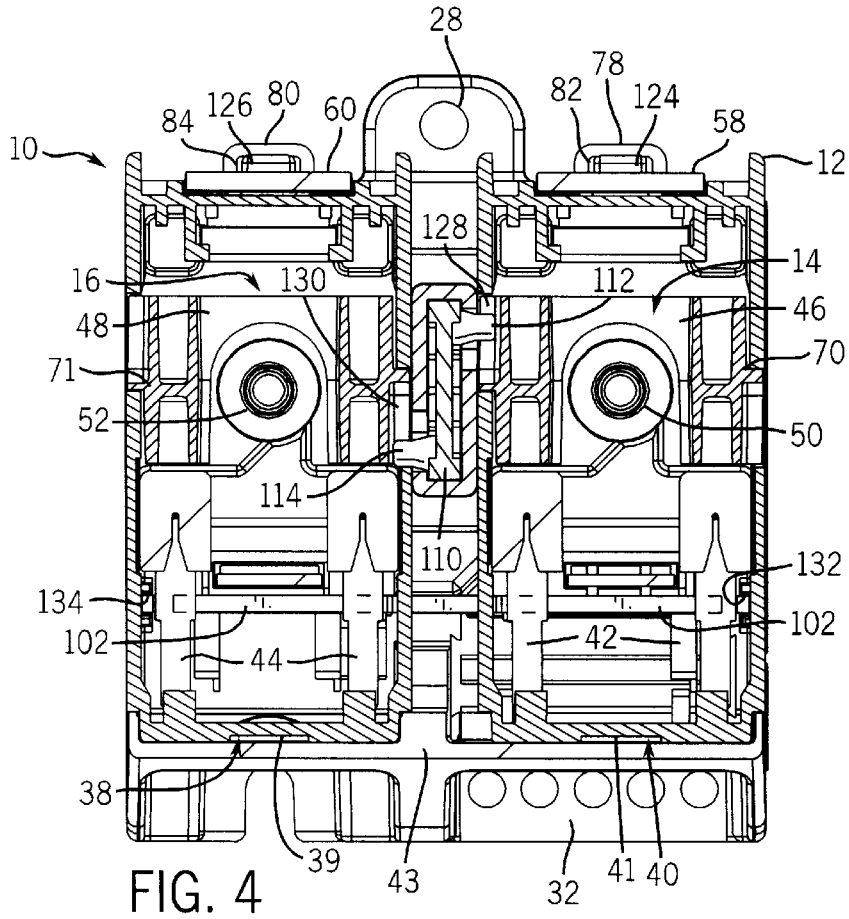
FIG. 4 is a cross-sectional, top view taken along line 4—4 of FIG. 3.

Referring now to FIG. 4, a cross-section of the electro-mechanical reversing contactor 10 is shown along lines 4—4 of FIG. 3 as viewed from above. FIG. 4 shows a third mounting hole 28 of the molded base 12 for mounting the reversing contactor 10 to a panel 22, as described with reference to FIG. 1. FIG. 4 shows clips 124, 126 of the contactor housings 58, 60 engaged in the apertures 82, 84 of the tabs 78, 80 of the base 12 to retain the powerheads 14, 16 in the base housing 12. The clips 39, 41 on the forward end of the powerheads 14, 16 lock under a cross bar 43 of base 12 to retain powerheads 14, 16 in cooperation with clips 124, 126. FIG. 4 is a view sectioned through carrier assemblies 70, 71, and taken through the interlock pawl 110, to more clearly show the interlock pins 112, 114 within a pair of interlock apertures 128, 130 of each carrier 70, 71, respectively. Additionally, the single circuit board 102 is shown positioned in the circuit board pocket 100, which includes a pair of channels 132, 134 to accept the circuit board 102 within the molded housing 12. This arrangement provides for use of a single circuit board to control both powerheads 14, 16.

Figure 5:
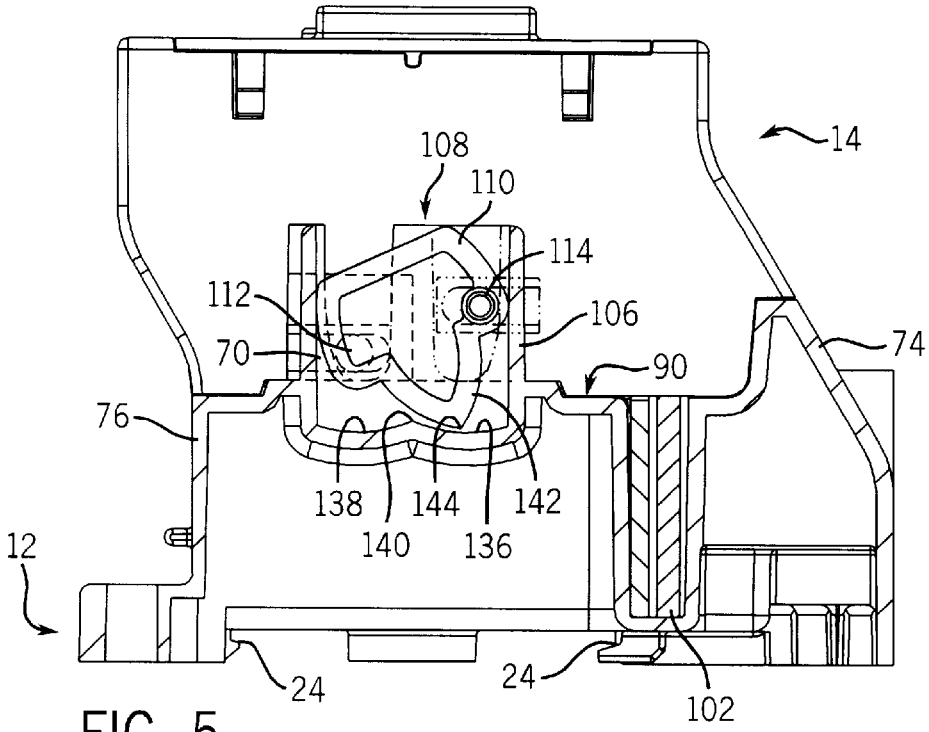
FIG. 5 is a cross-sectional, elevation view taken along line 5—5 of FIG. 3 with a first contactor energized.

FIG. 5 shows a cross-sectional view taken along 5—5 of FIG. 3 in which powerhead 14 is actuated, or energized, such that interlock pin 112 is forced downwardly by movement of carrier 70. The upwardly extending interlock tower 106, which is integrally formed with the center divider 90, has a pair of concave-shaped pawl seats 136, 138, at the lower end of the aperture opening 108. The concave pawl seats 136, 138 are adjacent to one another in an end-to-end manner to thereby form a center peak 140. The interlock pawl 110 has a V-shaped lower portion 142 forming a tip 144 at a lower end. When the powerheads 14, 16 are in a neutral position, the tip 144 engages the center peak 140, and either of the two powerheads 14, 16 can be activated. When a first powerhead 14 is energized, the interlock pin 112 of the interlock pawl 110, which is associated with the first powerhead 14, moves downward, as shown in FIG. 5, thereby tilting the V-shaped lower portion 142 of the interlocking pawl 110 into the opposing concave-shaped pawl seat 136, which thereby prevents the second powerhead 12 from movement until the first powerhead 14 is de-energized. That is, as long as the first powerhead 14 is energized, keeping the interlock pin 112 in the lower position, the second powerhead 12 is prevented from movement since downward movement on the interlock pin 114 would cause the V-shaped lower end 142 of the interlock pawl 110 to engage the upward slope of the concave pawl seat 136, thereby mechanically preventing both contactor powerheads from being energized at the same time. Similarly, when the powerhead 14 is de-energized, as indicated by the position of interlock pin 112 in FIG. 6, and the second powerhead 16 is energized, indicated by the position of interlock pin 114, the first powerhead 14 is prevented from movement due to the fact that any downward movement of the interlock pin 112 would cause the V-shaped lower portion 142 of the interlock pawl 110 to engage the upper slope of the concave pawl seat 138, and lock, until interlock pin 114 moves upward as caused by the de-energization of the powerhead 14.

Figure 6:
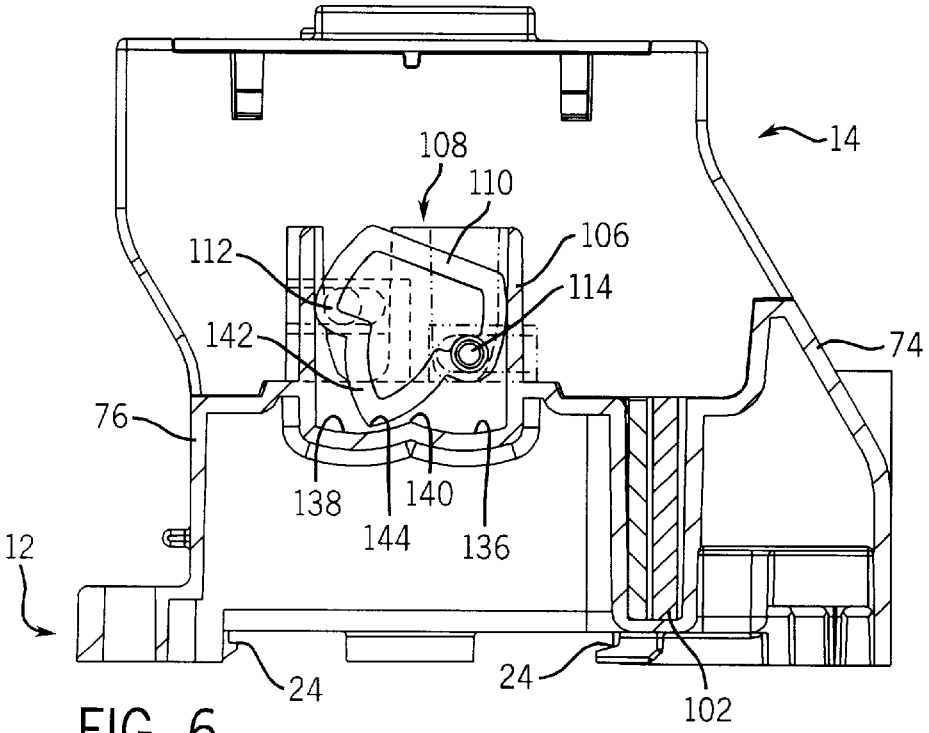
FIG. 6 is a cross-sectional, elevation view similar to FIG. 5 showing a second contactor energized.
Figure 7:
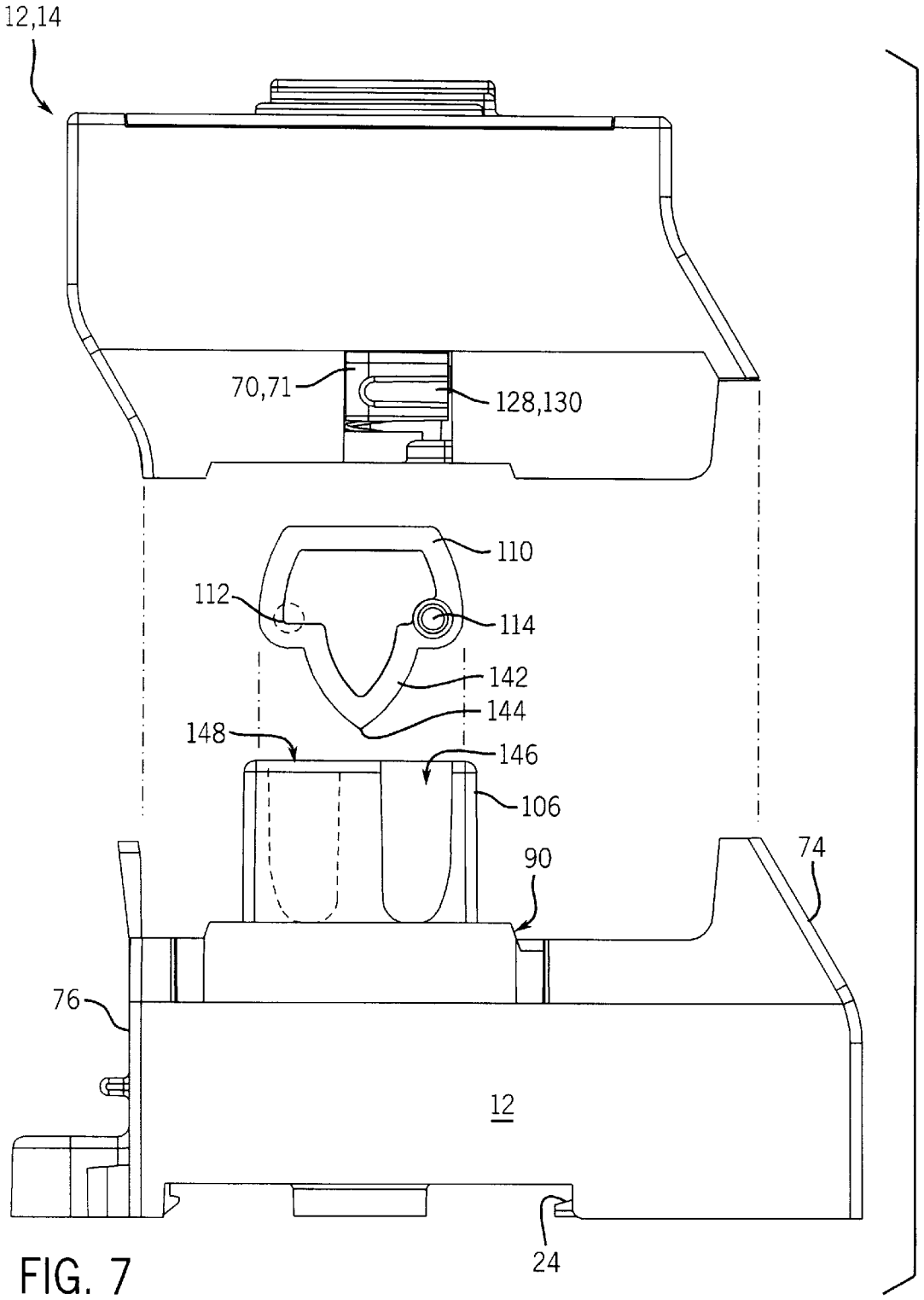
FIG. 7 is an exploded, elevation side view of the components depicted in FIGS. 5 and 6.

FIG. 7 shows an exploded view in elevation, of the arrangement shown in FIGS. 5 and 6. its shown, a pair of interlock pin channels 146, 148 are formed in the upwardly extending interlock tower 106 of the base 12 to allow insertion of the interlock pawl 110 and movement of the interlock pins 112, 114 so that the pawl 110 can pivot as shown in FIGS. 5 and 6. Each of the powerheads 14, 16 has an interlock aperture 128, 130 in a corresponding carrier 70, 71. When the powerhead 14, 16 is energized, the carrier 70, 71 moves in a downward direction. Since, in a reversing contactor arrangement, one of the powerheads provides power for a motor to operate in a forward direction, and the other powerhead provides power for the motor to operate in a reverse direction, it would be catastrophic for each to energize at the same time. The arrangement shown by this invention provides for a mechanical interlock between two contactor powerheads 14, 16 while mounted in a common base 12, with a minimal amount of moving components.

Figure 8:
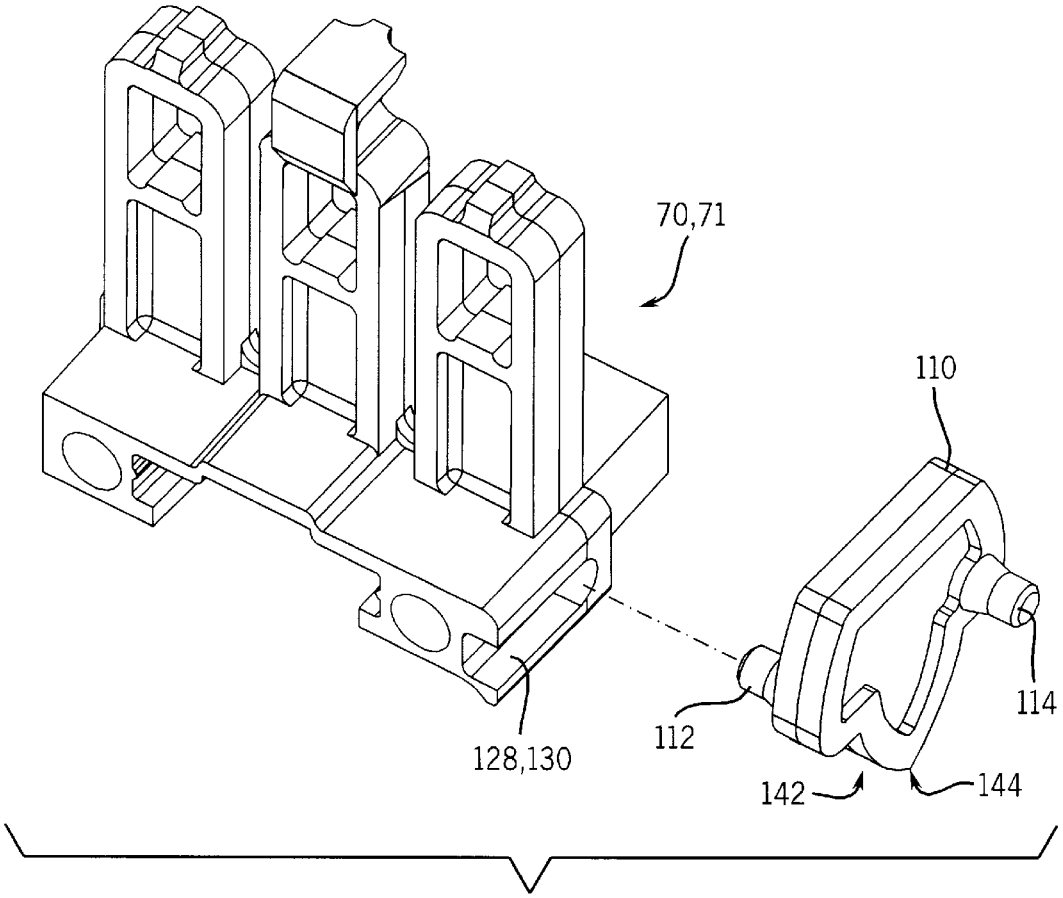
FIG. 8 is a perspective view showing a relationship between the locking pawl of FIG. 7 and a carrier assembly of a contactor.

FIG. 8 shows the contactor carrier 70, 71 having interlock apertures 128, 130 for engagement with an interlock pin 112, 114 of the interlock pawl 110. It is evident, that movement of the contact carrier 70, 71 up or down will cause the lower portion 142 of the interlock pawl 110 to pivot as described with reference to FIGS. 5 and 6.

Figure 9:
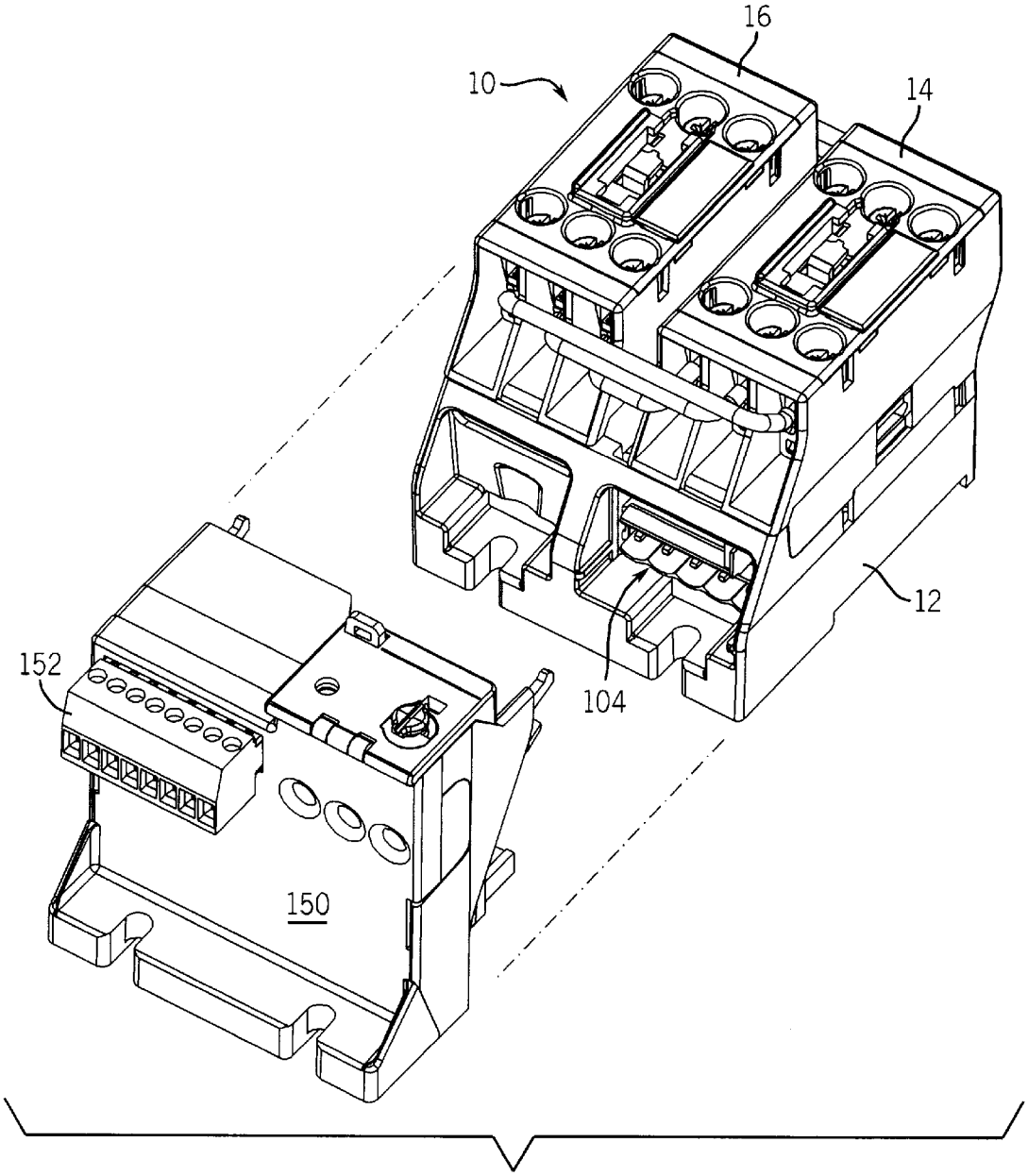
FIG. 9 is a perspective view of the electro-mechanical reversing contactor of FIG. 1 and an overload relay.

FIG. 9 shows an overload relay 150 adapted to connect to the reversing contactor 10 of the present invention in which a common molded base 12 is used to house two contactor powerheads 14, 16. The overload relay 50 connects to the single wire harness connector socket 104 of the reversing contactor 10, and in turn has harness connector 152 to connect a single wire harness to control both contactor powerheads 14, 16.

Accordingly, the present invention includes a reversing contactor having a single, common molded base with a plurality of upwardly extending sides and a center divider forming two powerhead sockets. The reversing contactor includes two powerheads, each powerhead having a housing, a set of stationary contacts mounted in the housing, a movable contact carrier having a set of movable contacts mounted thereon and in operable association with the stationary contacts, and an armature in movable relation with the movable contact carrier. The invention includes two coil and magnet assemblies each situated in a respective powerhead socket of the single, common molded base to apply a magnetic force to a respective armature and thereby move a respective movable contact carrier between a contact open position and a contact closed position.

The invention also includes a reversing contactor having a pair of powerheads. The powerheads have both stationary and movable contacts for opening and closing a circuit. The reversing contactor includes a pair of coil assemblies for driving the movable contacts in the powerheads and a single circuit board for controlling the pair of coil assemblies. The reversing contactor includes a common molded base having a plurality of upwardly extending sides and a center divider for receiving the pair of powerheads and the pair of coil assemblies therein. The common molded base also has a circuit board pocket for receiving and retaining the single circuit board therein to control both powerheads.

The invention also includes a reversing contactor housing and interlock assembly having a molded base with a bottom surface, a number of upwardly extending sides integrally molded to the bottom surface, and a center divider. The center divider has molded herein and upwardly extending interlock tower. The assembly also includes a pawl receivable in the upwardly extending interlock tower and having a pair of outwardly extending interlock pins, each engageable with a powerhead such that when one powerhead is energized, another powerhead is mechanically prevented from energizing.

The present invention has been described in terms of the preferred embodiment, and it is recognized that equivalents, alternatives, and modifications, aside from those expressly stated, are possible and within the scope of the appending claims.

What is claimed is:

1. A reversing contactor comprising:

a single, common molded base having a plurality of upwardly extending sides and a center divider forming two powerhead sockets;

two powerheads, each powerhead having a housing, a set of stationary contacts mounted in the housing, a movable contact carrier having a set of movable contacts mounted thereon and in operable association with the stationary contacts, and an armature in movable relation with the movable contact carrier;

two coil and magnet assemblies, each situated in a respective powerhead socket of the single, common molded base to apply a magnetic force to a respective armature and thereby move a respective movable contact carrier between a contact open position and a contact closed position; and a single circuit board engageable with each coil and magnet assembly, and wherein the single, common molded base further comprises a circuit board pocket to receive the single circuit board therein.

2. The reversing contactor of claim 1 wherein the circuit board pocket has a pair of channels, each located on an upwardly extending side, and the single circuit board has a single wire harness socket to provide control to both coil and magnet assemblies.

3. The reversing contactor of claim 2 further comprising an overload relay assembly connected to the reversing contactor and the single wire harness socket.

4. The reversing contactor of claim 1 wherein the center divider includes an upwardly extending interlock tower molded therein, the reversing contactor further comprising a pawl receivable in the upwardly extending interlock tower and having a pair of outwardly extending interlock pins, each engageable with a powerhead such that when one powerhead is energized, another powerhead is mechanically prevented from energizing.

5. The reversing contactor of claim 4 wherein the center divider has a pair of concave-shaped pawl seats each adjacent end-to-end to one another thereby forming a center peak, and the pawl has a V-shaped lower portion engaging the center peak when the two powerheads are both de-energized, and wherein when a first powerhead is energized, the interlock pin associated with the first powerhead moves downward tilting the V-shaped lower portion of the pawl into one of the concave-shaped pawl seats, thereby locking the second powerhead from movement until the first powerhead is de-energized.

6. The reversing contactor of claim 1 wherein the single, common molded base includes a mounting slot on a lower end to engage a rail for rail-mounting and a plurality of mounting holes to receive mounting bolts for panel mounting.

7. The reversing contactor of claim 1 wherein the single, common molded base includes a pair of apertures on a front wall and a pair of apertures on a back wall, and wherein each powerhead includes front and back clips engageable with one aperture of each pair of apertures.

8. The reversing contactor of claim 1 wherein the single, common molded base includes a plurality of L-shaped guides on a bottom section to center each coil and magnet assembly in the respective powerhead socket.

9. A reversing contactor housing and interlock assembly comprising:

a pair of powerheads having stationary and movable contacts for opening and closing a circuit;

a pair of coil assemblies for driving the movable contacts in the powerheads;

a single circuit board for controlling the pair of coil assemblies;

a common molded base having a plurality of upward extending sides and a center divider for receiving the pair of powerheads and the pair of coil assemblies therein, and wherein the common molded base has a circuit board pocket for receiving and retaining the single circuit board therein.

10. The reversing contactor of claim 9 wherein the center divider has a tower extending upwardly for receiving a locking mechanism therein, the locking mechanism engaging each of the powerheads receivable in the common molded base for preventing actuation of a second powerhead while a first powerhead is energized.

11. The reversing contactor of claim 9 further comprising a single overload relay engageable with the common molded base.

12. The reversing contactor of claim 9 wherein the common molded base includes a pair of apertures on a front wall and a pair of apertures on a back wall, and wherein each powerhead includes front and back clips engageable with one aperture of each pair of apertures.

13. The reversing contactor of claim 9 wherein the common molded base includes a plurality of L-shaped guides on a bottom section to center each coil assembly in the respective powerhead socket.

14. The reversing contactor of claim 9 further comprising a mounting slot on a lower end to engage a rail for rail-mounting and a plurality of mounting holes to receive mounting, bolts for panel mounting.

15. A reversing contactor housing and interlock assembly comprising:

a molded base unit having a bottom surface, a plurality of upwardly extending sides integrally molded to the bottom surface, and a center divider, the center divider having molded therein an upwardly extending interlock tower;

a pawl receivable in the upwardly extending interlock tower and having a pair of outwardly extending interlock pins, each engageable with a powerhead such that when one powerhead is energized, another powerhead is mechanically prevented from energizing;

two coil and magnet assemblies, two powerheads, and a single circuit board connected to both powerheads; and wherein the molded base unit further comprises a circuit board pocket extending across one side of the molded base unit to receive therein the singly circuit board.

16. The reversing contactor housing and interlock assembly of claim 15 further comprising a single wire harness socket to provide control to both powerheads, and an overload relay assembly connected to the single wire harness socket.

17. The reversing contactor housing and interlock assembly of claim 15 further comprising first and second powerheads and wherein the center divider has a pair of concave-shaped pawl seats and each adjacent end-to-end to one another thereby forming a center peak, and the pawl has a V-shaped lower portion engaging the center peak when the first and second powerheads are both de-energized, and wherein when a first powerhead is energized, the interlock pin associated with the first powerhead moves downward tilting the V-shaped lower portion of the pawl into one of the concave-shaped pawl seats, thereby locking the second powerhead from movement until the first powerhead is de-energized.

18. The reversing contactor housing and interlock assembly of claim 15 further comprising a mounting slot on a lower end to engage a rail for rail-mounting and a plurality of mounting holes to receive mounting bolts for panel mounting.

* * * * *